US009509068B2

(12) United States Patent
Hansen

(10) Patent No.: US 9,509,068 B2
(45) Date of Patent: Nov. 29, 2016

(54) CREEPAGE DESIGN TERMINAL STRIP

(71) Applicant: Hamilton Sundstrand Corporation, Charlotte, NC (US)

(72) Inventor: Harold J Hansen, Hamden, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 14/614,751

(22) Filed: Feb. 5, 2015

(65) Prior Publication Data

US 2016/0233592 A1 Aug. 11, 2016

(51) Int. Cl.
*H01R 9/22* (2006.01)
*H01R 13/52* (2006.01)

(52) U.S. Cl.
CPC ..... *H01R 9/226* (2013.01); *H01R 13/52* (2013.01)

(58) Field of Classification Search
CPC ..... H01R 13/514; H01R 9/24
USPC ..... 439/934, 709, 718
See application file for complete search history.

(56) References Cited

U.S. PATENT DOCUMENTS 2,923,913 A * 2/1960 Kulka ..... H01R 9/24 439/491
3,430,187 A * 2/1969 De Man ..... H01R 13/5221 24/136 R
3,611,247 A * 10/1971 Adams ..... H01R 13/502 439/106
4,674,807 A * 6/1987 Boteler ..... H01R 13/652 439/106
5,063,314 A * 11/1991 DeSantis ..... H01R 29/00 310/71
5,403,210 A * 4/1995 Hasegawa ..... H01R 9/2491 439/721
6,508,679 B2 * 1/2003 Han ..... H01R 4/46 439/488
8,790,135 B2 * 7/2014 Maegawa ..... H01R 43/24 439/246

* cited by examiner

*Primary Examiner* — Phuong Dinh
(74) *Attorney, Agent, or Firm* — Kinney & Lange, P.A.

(57) ABSTRACT

A terminal strip and a method of improving a creepage dielectric strength of the same includes a base plate, a barrier, each constructed from an insulating material, and a plurality of terminals constructed from a conducting material. The terminals are connected to the base plate and spaced along a surface thereof. The barrier is disposed between adjacent terminals and configured such that the creepage dielectric strength of the insulating material between adjacent terminals is equal to or greater than a bulk dielectric strength of the insulating material between adjacent terminals.

20 Claims, 4 Drawing Sheets

CREEPAGE DESIGN TERMINAL STRIP

BACKGROUND

The present invention relates generally to electrical connections and, more particularly, to terminal strips with an improved creepage design.

Electrical connections having multiple electrically-isolated terminals, such as a terminal strip, fail when electric fields transmitted by components within the electrical connection exceed the dielectric strength of the electrically-insulating materials that isolate the terminals. Failure can occur in one or more of three modes; electrical breakdown along the insulating material surfaces between the terminals (creepage), electrical breakdown through the insulating material (bulk), or electrical breakdown across a gap between conductors (gap). Because electrical connections are readily designed to avoid electrical breakdown across a gap between conductors and the bulk dielectric strength of an insulating material is typically greater than the creepage dielectric strength of an insulating material, electrical connections can commonly fail by electrical breakdown along the insulating surfaces. Moreover, contamination (e.g. dirt, grease, oil) within the electrical connection further reduces the creepage dielectric strength, particularly after the electrical connection is placed in service.

Therefore, a need exists to provide an electrical connection such as a terminal strip in which the insulating components are configured to improve the creepage dielectric strength and limit contamination within the electrical connection.

SUMMARY

A terminal strip and a method of improving a creepage dielectric strength of the same includes a base plate, a barrier, each constructed from an insulating material, and a plurality of terminals constructed from a conducting material. The terminals are connected to the base plate and spaced along a surface thereof. The barrier is disposed between adjacent terminals and configured such that the creepage dielectric strength of the insulating material between adjacent terminals is equal to or greater than a bulk dielectric strength of the insulating material between adjacent terminals.

DETAILED DESCRIPTION

Figure 1A:
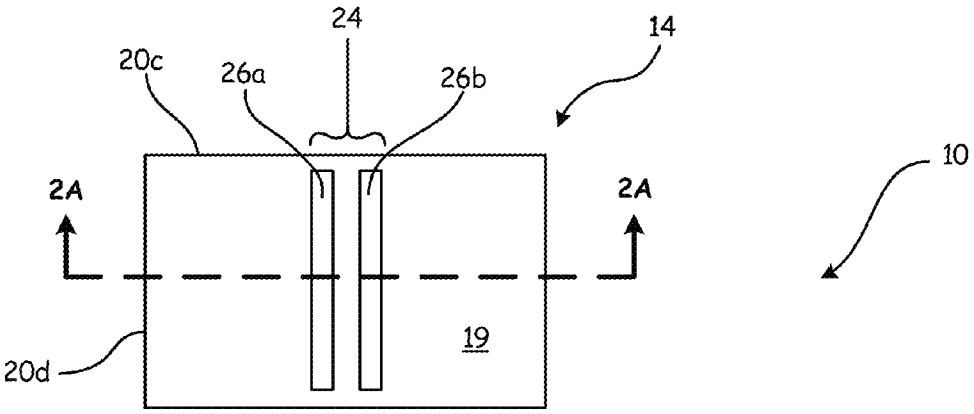
FIG. 1A is a top view of a terminal strip with an improved creepage design.
Figure 1C:
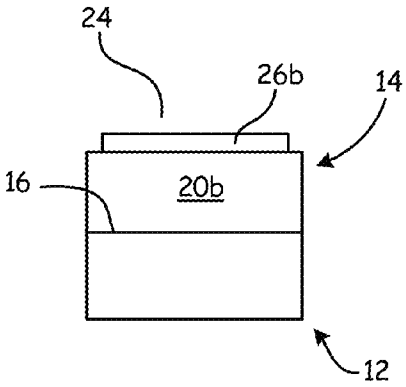
FIG. 1C is an end view of a terminal strip with an improved creepage design.
Figure 1B:
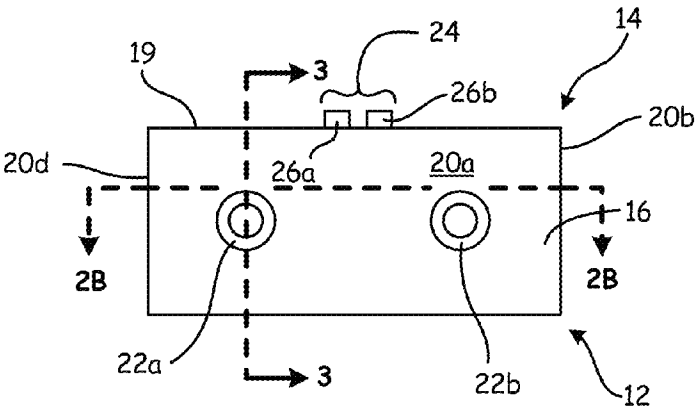
FIG. 1B is a side view of a terminal strip with an improved creepage design.

FIGS. 1A, 1B, and 1C show top, side, and end views of terminal strip 10 with an improved creepage design in accordance with the present invention. Terminal strip 10 includes base plate 12 and cover 14 that mate with each other along interface 16 to define and enclose a cavity for terminals 18*a* and 18*b* (not shown in FIGS. 1A, 1B, and 1C). Cover 14 includes top wall 19 and side walls 20*a*, 20*b*, 20*c*, and 20*d*. Some of side walls 20*a*, 20*b*, 20*c*, and 20*d* cooperate with base plate 12 to form conductor apertures 22*a* and 22*b* located at interface 16. In the embodiment shown in FIG. 1B, conductor apertures 22*a* and 22*b* have a circular cross section and are formed in side wall 20*a* and base plate 12. Furthermore, conductor apertures 22*c* and 22*d* (not shown in FIG. 1B) are formed by side wall 20*c* and base plate 12. Barrier 24, which will be discussed further below, protrudes through top wall 19. In some embodiments, barrier 24 includes first and second structures 26*a* and 26*b*. Cover 14 is attached to base plate 12 at interface 16 such that cover 14 can be removed to access terminals 18*a* and 18*b* (not shown in FIGS. 1A-C). Mechanical attachments, not illustrated in FIGS. 1A-C, allowing access to terminals 18*a* and 18*b* (not shown in FIGS. 1A-C) include threaded fasteners, snap fits, and tabs among other connections known to persons skilled in the art.

Base plate 12 and cover 14 are constructed from an electrically-insulated material suitable for the environmental conditions under which the terminal strip will operate. In some embodiments, base plate 12 and cover 14 can be constructed from an electrically-insulating polymer having a bulk dielectric strength greater than or equal to 300 V/mil (11.8 kV/mm) and less than or equal to 500 V/mil (19.7 kV/mm) and a creepage dielectric strength greater than or equal to 3 V/m (0.1 kV/mm) and less than or equal to 5 V/mil (0.2 kV/mm). Using such a material, base plate 12 and cover 14 can be molded such that each includes a single molded structure that can be adapted, via machining or other post-molding operations, to house terminals 18*a* and 18*b*.

Figure 2A:
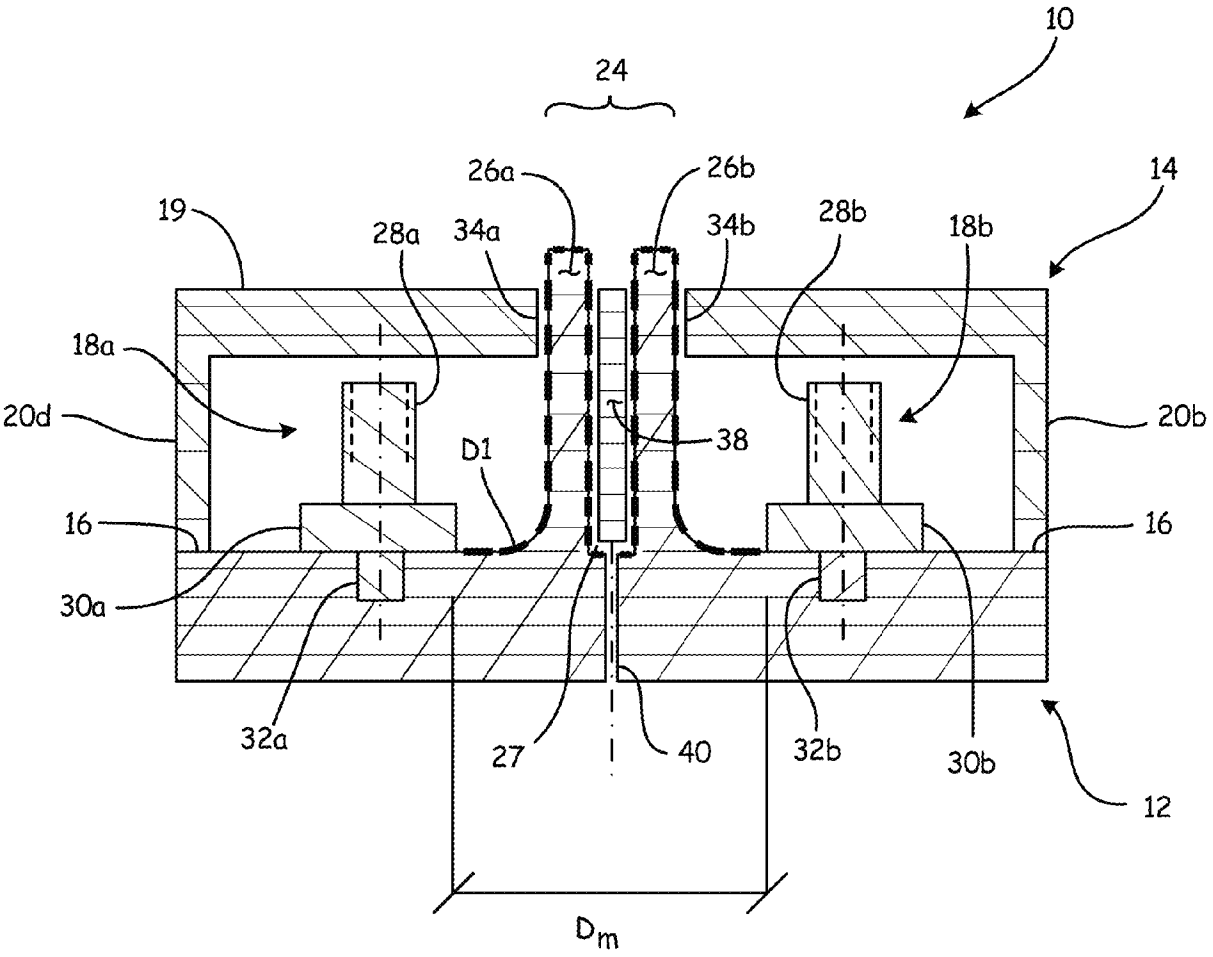
FIG. 2A is a cross-sectional view of the terminal strip taken along line 2A-2A in FIG. 1A.

FIG. 2A is a cross-sectional view of terminal strip 10 taken along line 2A-2A shown in FIG. 1A. Terminals 18*a* and 18*b* include threaded portions 28*a* and 28*b*, contact portions 30*a* and 30*b*, and attachment portions 32*a* and 32*b*, respectively. Terminals 18*a* and 18*b* are attached to base plate 12 via attachment portions 32*a* and 32*b* using a mechanical attachment method tailored to the material of base plate 12. In some embodiments, attachment portions 32*a* and 32*b* are knurled. However, it will be appreciated that other methods could be used. For example, attachment portions 32*a* and 32*b* could be threaded into an insert (not shown) that is joined (e.g. via press fit or adhesive) to base plate 12. Contact portions 30*a* and 30*b* are shaped to receive a connection end of a conductor (not shown in FIG. 2A). In some embodiments, contact portions 30*a* and 30*b* are cylindrical. However, contact portions 30*a* and 30*b* can be rectangular or another suitable shape adapted to the conductor connection end (not shown in FIG. 2A). Threaded portions 28*a* and 28*b* are adapted to accept a nut (not shown) in order to join at least two conductors (not shown) at each terminal 18*a* and 18*b*. Terminals 18*a* and 18*b* are constructed from an electrically-conductive material (e.g. copper, copper alloys, carbon steel alloys) relative to the electrically-insulating material used to construct base plate 12 and cover 14.

Barrier 24 extends from base plate 12 and is positioned between terminals 18*a* and 18*b* along base plate 12 to increase the creepage dielectric strength of terminal strip 10 between terminals 18*a* and 18*b*. Barrier 24 can be adapted to the geometry of terminal strip 10 by having a variety of shapes so that the distance, defined by line D1, between terminals 18*a* and 18*b* along the surfaces of base plate 12 and barrier 24 is greater than the minimum distance between terminals defined by Dm. In some embodiments, barrier 24 has a rectangular cross-section and extends from base plate 12 to form a protrusion (e.g. a fin-like shape). Preferably, barrier 24 includes structures 26*a* and 26*b* that have a rectangular cross-section. Structures 26*a* and 26*b* are joined to base plate 12 and spaced along base plate 24 such that void 27 is formed between structures 26*a* and 26*b*. Edges along line D1, such as the interfaces between structures 26*a* and 26*b* and base plate 24 or the exterior edges of structures 26*a* and 26*b* that protrude above top wall 19, can have a radius to further improve the creepage dielectric strength between terminals 18*a* and 18*b*. Structures 26*a* and 26*b* extend through apertures 34*a* and 34*b* formed in top wall 19. Apertures 34*a* and 34*b* are configured such that there is clearance between cover 14 and barrier 24, the clearance being selected based on the limits of manufacture.

Cover 14 can further include structure 38 that extends from top wall 19 towards base plate 12. Structure 38 is configured to cooperate with barrier 24 to further improve the creepage dielectric strength between terminals 18*a* and 18*b* by extending between structures 26*a* and 26*b*. Preferably, structure 38 is configured such that the clearance between structure 38 and base plate 12 accounts for manufacturing tolerances but otherwise extends the length of void 27 between structures 26*a* and 26*b*. As such, the surface path along which electrical breakdown occurs is defined by line D1.

Barrier 24, including structures 26*a* and 26*b*, and structure 38 can be formed from an electrically-insulating material suitable for the environmental conditions under which terminal strip 10 operates. Preferably, barrier 24 and/or structures 26*a-b*, and structure 38 are integrally constructed from base plate 12 and cover 14, respectively, and therefore, are constructed from the same electrically-insulating material.

Base plate 12 can include passage 40 extending therethrough and positioned relative to barrier 24 to allow contaminants to escape terminal strip 10. Preferably, passage 40 has a circular cross-section extending through base plate 12 at a location between structures 26*a* and 26*b*. Although the embodiment shown in FIG. 2A has a single passage 40, more than one passage 40 can be used, as necessary, to provide an escape path for contaminants.

Figure 2B:
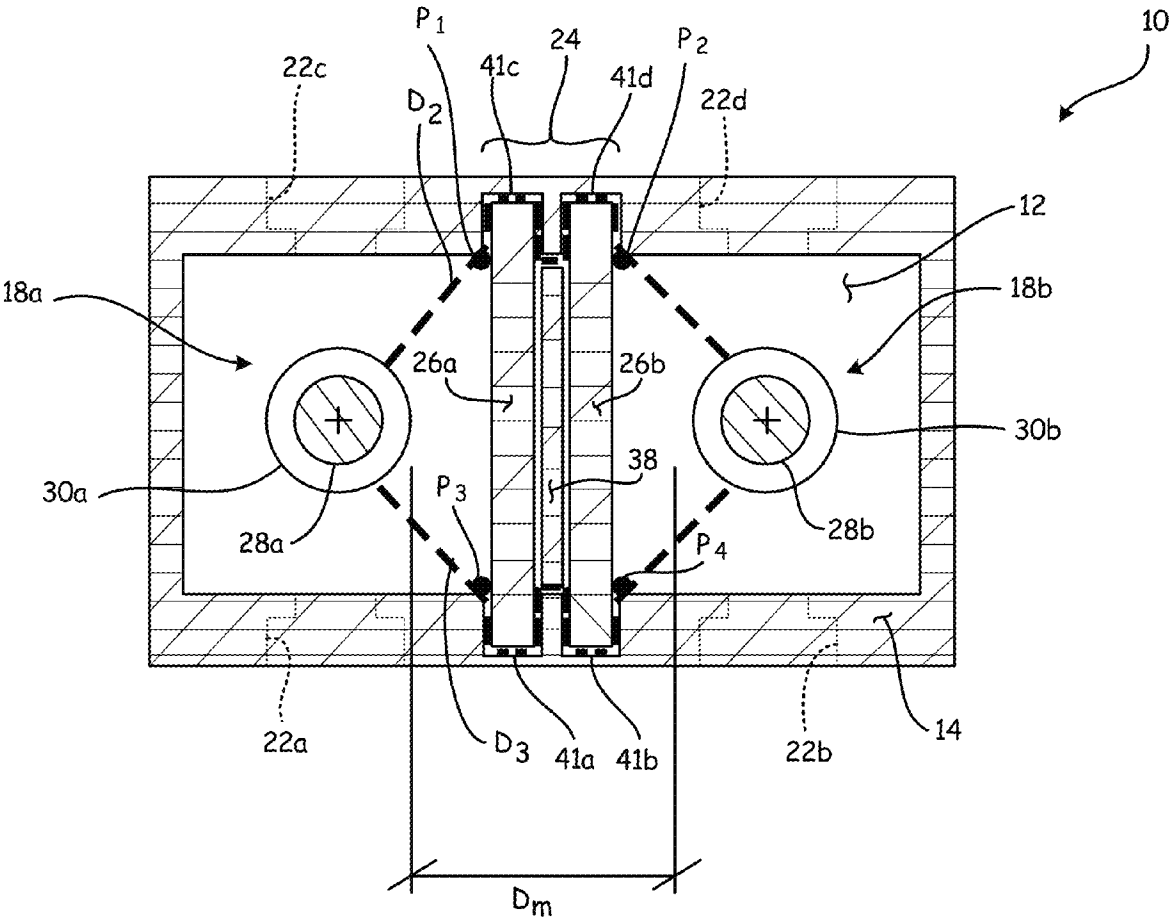
FIG. 2B is a cross-sectional view of the terminal strip taken along line 2B-2B in FIG. 1B.

FIG. 2B is a cross-sectional view of terminal strip 10 taken along line 2B-2B in FIG. 1B that shows additional creepage paths D2 and D3 and additional features of barrier 24. Paths D2 and D3 each extend from contact portion 30*a* of terminal 18*a* along base plate 12 to opposing interfaces between barrier 24 and base plate 12 at points P1 and P3, respectively. From points P1 and P3, paths D2 and D3 extend along a side wall of base plate 12 to cover 14 at interface 16 (not shown in FIG. 2B). Next, paths D2 and D3 extend across barrier 24 and down opposing side wall portions of base plate 12 at points P2 and P4, respectively. Then, paths D2 and D3 extend along base plate 12 to contact portion 30*b* of terminal 18*b*. Barrier 24 can extend into portions of cover 14 (not shown in FIG. 2B) to increase the creepage dielectric strength along paths D2 and D3. In some embodiments, structures 26*a* and 26*b* extend into grooves 41*a*, 41*b*, 41*c*, and 41*d* formed in cover 14. Grooves 41*a* and 41*b* are formed in a portion of cover 14 that is opposite grooves 41*c* and 41*d* also formed by portions of cover 14. Grooves 41*a*, 41*b*, 41*c*, and 41*d* extend from interface 16 (not shown in FIG. 2B) into cover 14 such that grooves 41*a*, 41*b*, 41*c*, and 41*d* are configured to receive structures 26*a* and 26*b*. Structure 38 is disposed between structures 26*a* and 26*b* and between opposing walls of base plate 12. Using this arrangement, structures 26*a* and 26*b* can be integrally-formed with base plate 12.

In other embodiments, structures 26*a* and 26*b* can be separate from base plate 12 and cover 14. As such, structures 26*a* and 26*b* can have a cross-like cross-section. Each leg of the cross-section can extend through one or both of base plate 12 and cover 14 in a manner similar to structures 26*a* and 26*b* extending through top wall 19 as depicted in FIG. 2A.

Figure 3:
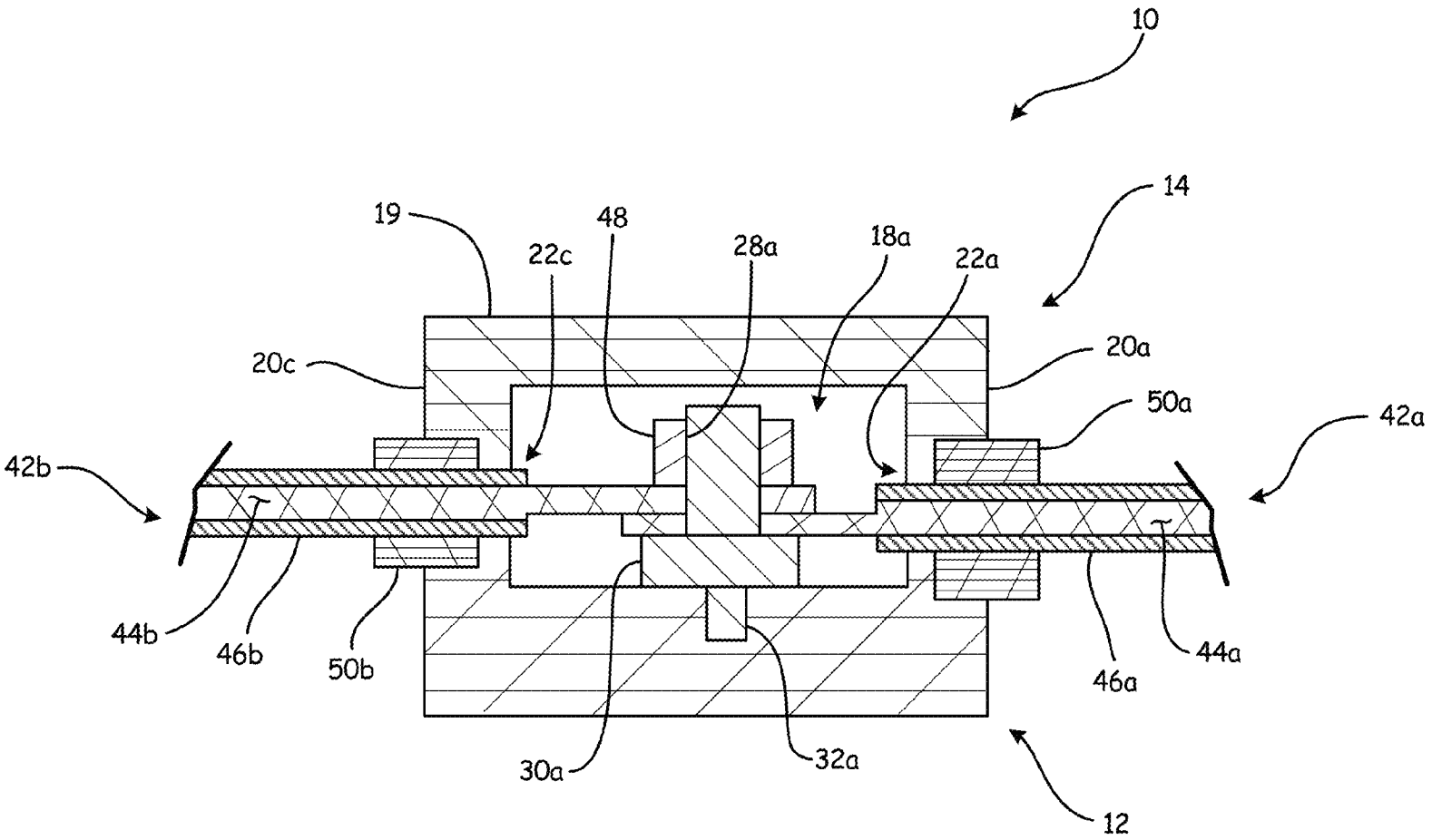
FIG. 3 is a cross-sectional view of the terminal strip taken along line 3-3 in FIG. 1B.

FIG. 3 is a cross-sectional view of terminal strip 10 taken along line 3-3 in FIG. 1B, and, additionally, illustrates an electrical connection between cables 42*a* and 42*b* at terminal 18*a*. Cables 42*a* and 42*b* include conductors 44*a* and 44*b* and insulating layers 46*a* and 46*b*, respectively. Conductors 44*a* and 44*b* are formed from one of many conductive materials known by those skilled in the art. In some embodiments, conductors 44*a* and 44*b* are formed from copper or a copper alloy. Likewise, insulating layers 46*a* and 46*b* are formed from one of many electrically-insulating materials known by those skilled the art. Moreover, insulating layers 46*a* and 46*b* are formed around the periphery of conductors 44*a* and 44*b* to electrically-insulate conductors 46*a* and 46*b* from surrounding components. Conductors 44*a* and 44*b* have mating surfaces at terminal 18*a* that are secured to terminal 18*a* by nut 48.

Seals 50*a* and 50*b* are disposed about cables 42*a* and 42*b*, respectively, at locations where cables 42*a* and 42*b* pass through conductor apertures 22*a* and 22*c*, respectively. Seals 50*a* and 50*b* can extend a length along conductors 42*a* and 42*b*, respectively, which is greater than the depth of conductor apertures 22*a* and 22*b* such that a portion of seals 50*a* and 50*b* protrude therefrom. Seals 50*a* and 50*b* are constructed from an elastomeric material suitable for the environmental conditions within which terminal strip 10 operates. In some embodiments, seals 50*a* and 50*b* are configured such that when cover 14 joins to base plate 12, seals 50*a* and 50*b* are compressed between respective surfaces of cover 14 and base plate 12 without damaging cables 42*a* and 42*b*. Such an arrangement prevents contaminants from entering terminal strip 10 through conductor apertures 22*a* and 22*c*.

Although the embodiment of terminal strip 10 shown in FIGS. 1A-C, 2A-B, and 3 includes two terminals (terminals 18*a* and 18*b*), a single barrier (barrier 24), and a single mating structure extending from cover 14 (structure 38), alternative embodiments of terminal strip 10 may include a repeating pattern of terminals and barriers to form a terminal strip with more than two terminals. For example, an alternative embodiment of terminal strip 10 can include four terminals and three barriers, each barrier having a structure extending from the cover in accordance with the embodiment shown in FIGS. 1A-C, 2A-B, and 3.

In each embodiment, the creepage dielectric strength between terminals can be improved in the same manner. Referring again to FIGS. 2A and 2B, distance Dm is the minimum distance between terminals 18*a* and 18*b*. Without barrier 24 and/or structure 38, terminal strip 10 is susceptible to electrical breakdown along the surface of base plate 12. Terminal strip 10 is particularly susceptible to electrical breakdown along the surface of base plate 12 when contaminants are allowed to deposit between terminals 18*a* and 18*b*, although contamination is not necessary for electrical breakdown to occur. When barrier 24 and/or structure 38 is added, the surface distance over which electrical breakdown can occur is increased and is represented by distance D1 in FIG. 2A and distances D2 and D3 in FIG. 2B, which extend along base plate 12 and structures 26*a* and 26*b* from terminal 18*a* to terminal 18*b*. Structure 26*a*, structure 26*b*, and structure 38 can be configured such that the creepage dielectric strength between terminals 18*a* and 18*b* along distances D1, D2, and D3 is equal to or greater than the bulk dielectric strength through base plate 12 or through structure 26*a*, structure 26*b*, and structure 38, effectively eliminating one mode of electrical breakdown of terminal strip 10. Moreover, cover 14, passage 40, and seals 50*a* and 50*b* (see FIG. 3) either prevent contaminants from entering terminal strip 10 or allow contaminants to escape terminal strip 10, thereby improving one of the factors contributing to the creepage dielectric strength of terminal strip 10. In one embodiment, the bulk dielectric strength of each structure 26*a*, structure 26*b*, and structure 38 is sufficient to prevent bulk electrical breakdown and the creepage dielectric strength is equal to the combined bulk dielectric strength of structures 26*a*, 26*b*, and 38.

Discussion of Possible Embodiments

The following are non-exclusive descriptions of possible embodiments of the present invention.

A terminal strip according to an exemplary embodiment of this disclosure, among other possible things, includes a base plate constructed from an insulating material, a plurality of terminals constructed from a conducting material, and a barrier constructed from an insulating material. The plurality of terminals is attached to the base plate and spaced along a surface thereof. The barrier is disposed between adjacent terminals and configured such that a creepage dielectric strength of the insulating material between adjacent terminals is equal to or greater than a bulk dielectric strength of the insulating material between adjacent terminals.

The terminal strip of the preceding paragraph can optionally include, additionally and/or alternatively, any one or more of the following features, configurations and/or additional components:

A further embodiment of the foregoing terminal strip can include a cover constructed from the insulating material. The cover can include a top wall spaced from and disposed opposite the base plate and a plurality of side walls, each side wall extending from the top wall towards the base plate. At least one of the side walls can be mechanically attached to the base plate. The base plate, the top wall, and the plurality of side walls can define a cavity containing the plurality of terminals.

A further embodiment of any of the foregoing terminal strips, wherein the cover can include an aperture extending through and defined by the top wall. The aperture can be adapted to receive the barrier, and the barrier can extend through the top wall at the aperture.

A further embodiment of any of the foregoing terminal strips, wherein the cover can include a cover barrier constructed from an insulating material and extending from the top plate towards the base plate. The cover barrier can be disposed between adjacent terminals.

A further embodiment of any of the foregoing terminal strips can include a plurality of conductor apertures, a plurality of electrical conductors, and a plurality of seals. Each conductor aperture can be defined by one of the side walls of the cover and the base plate. Each conductor can be aligned with one of the terminals. Each seal can surround a portion of one of the electrical conductors. Each conductor can extend through one of the conductor apertures and attach to one of the terminals. The seal can be configured to be received within one of the conductor apertures.

A further embodiment of any of the foregoing terminal strips, wherein the barrier can include a first structure and a second structure spaced from the first structure along the base plate.

A further embodiment of any of the foregoing terminal strips, wherein the cover can include a third structure extending into the cavity from the top wall towards the base plate and is disposed between the first and second structures.

A further embodiment of any of the foregoing terminal strips, wherein the cover can include a plurality of apertures extending through and defined by the top wall. Each aperture can be adapted to receive one of the first and second structures. The first and second structures can extend through the top wall at one of the plurality of apertures.

A further embodiment of any of the foregoing terminal strips, wherein the base plate can define a passage extending therethrough. The passage can be disposed between the first and second structures.

A further embodiment of any of the foregoing terminal strips, wherein the first and second structures can be integral with the base plate and the third structure can be integral with the cover.

A further embodiment of any of the foregoing terminal strips can include a plurality of barriers constructed from the insulating material and extending from the base plate. Each barrier can be disposed between adjacent terminals and can be configured such that the creepage dielectric strength of the insulating material between adjacent terminals is equal to or greater than the bulk dielectric strength of the insulating material between adjacent terminals.

A further embodiment of any of the foregoing terminal strips, wherein each barrier can include a first structure and a second structure spaced from the first structure along the base plate.

A further embodiment of any of the foregoing terminal strips, wherein the cover includes a plurality of third structures extending into the cavity from the top wall towards the base plate. Each third structure can be disposed between the first and second structures of each barrier.

A method of improving the dielectric strength of a terminal strip between adjacent terminals in accordance with an exemplary embodiment of this disclosure, among other possible things, includes providing a terminal strip having a base plate constructed from an insulating material, a plurality of terminals constructed from a conducting material, and a barrier constructed from an insulating material. Each terminal is attached to the base plate space along a surface thereof. The barrier is disposed between adjacent terminals and includes a first structure and a second structure spaced from the first structure along the base plate. The method further includes configuring the barrier such that a creepage dielectric strength of the terminal strip between adjacent terminals is equal to or greater than a bulk dielectric strength of the terminal strip between adjacent terminals.

The method of the preceding paragraph can optionally include, additionally and/or alternatively, any one or more of the following features, configurations and/or additional components:

A further embodiment of the foregoing method can include providing a cover constructed from the insulating material. The cover can include a top wall spaced from and disposed opposite the base plate, a plurality of side walls extending from the top wall, and a plurality of third structures extending into a cavity defined by the base plate, top wall, and the plurality of side walls. At least one of the side walls can be mechanically attached to the base plate. The cavity can contain the plurality of terminals. Each third structure can be disposed between the first and second structures of each barrier.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A terminal strip comprising:

a base plate constructed from an insulating material;

a plurality of terminals constructed from a conducting material and attached to the base plate, wherein the terminals are spaced along the base plate;

a barrier constructed from the insulating material and extending from the base plate, wherein the barrier is disposed between adjacent terminals and configured such that a creepage dielectric strength of the insulating material between adjacent terminals is equal to or greater than a bulk dielectric strength of the insulating material between adjacent terminals; and a cover constructed from the insulating material, wherein the cover comprises:

a top wall spaced from and disposed opposite the base plate;

a plurality of side walls, each side wall extending from the top wall towards the base plate, wherein at least one of the side walls is mechanically attached to the base plate, and wherein the base plate, the top wall, and the plurality of side walls define a cavity containing the plurality of terminals; and a first aperture extending through and defined by the top wall, wherein the first aperture is adapted to receive the barrier, and wherein the barrier extends through the top wall at the first aperture.

2. The terminal strip of claim 1, wherein the cover further comprises:

a cover structure constructed from the insulating material and extending from the top plate towards the base plate, wherein the cover structure is disposed between adjacent terminals.

3. The terminal strip of claim 1 and further comprising:

a plurality of conductor apertures, wherein each conductor aperture is defined by one of the side walls of the cover and the base plate, and wherein each conductor aperture is aligned with one of the terminals;

a plurality of electrical conductors; and a plurality of seals, each seal surrounding a portion of one of the electrical conductors, wherein each electrical conductor extends through one of the conductor apertures and attaches to one of the terminals, and wherein each seal is configured to be received within one of the conductor apertures.

4. The terminal strip of claim 1, wherein the barrier comprises:

a first structure; and a second structure spaced from the first structure along the base plate.

5. The terminal strip of claim 4, wherein the cover further comprises:

a third structure extending into the cavity from the top wall towards the base plate and disposed between the first and second structures.

6. The terminal strip of claim 5, wherein the cover further comprises:

a second aperture extending through and defined by the top wall, wherein each of the first and second apertures is adapted to receive one of the first and second structures, and wherein the first and second structures extend through the top wall at one of the first and second apertures.

7. The terminal strip of claim 4, wherein the base plate defines a passage extending therethrough, and wherein the passage is disposed between the first and second structures.

8. The terminal strip of claim 5, wherein the first and second structures are integral with the base plate, and wherein the third structure is integral with the cover.

9. The terminal strip of claim 1 and further comprising:

a plurality of barriers constructed from the insulating material and extending from the base plate, wherein each barrier is disposed between adjacent terminals and configured such that the creepage dielectric strength of the insulating material between adjacent terminals is equal to or greater than the bulk dielectric strength of the insulating material between adjacent terminals, and where each barrier comprises:

a first structure; and a second structure spaced from the first structure along the base plate.

10. The terminal strip of claim 9, wherein the cover further comprises:

a plurality of third structures extending into the cavity from the top wall towards the base plate, wherein each third structure is disposed between the first and second structures of each barrier.

11. A method of improving the dielectric strength of a terminal strip between adjacent terminals, the method comprising:

providing a terminal strip comprising:

a base plate constructed from an insulating material;

a plurality of terminals constructed from a conducting material and attached to the base plate, wherein the terminals are spaced along the base plate; and a barrier extending from the base plate, the barrier comprising:

a first structure extending from the base plate; and a second structure extending from the base plate and spaced from the first structure along the base plate, wherein the barrier is constructed from the insulating material, and wherein the first and second structures are disposed between adjacent terminals; and configuring the barrier such that a creepage dielectric strength of the terminal strip between adjacent terminals is equal to or greater than a bulk dielectric strength of the terminal strip between adjacent terminals.

12. The method of claim 11 and further comprising:

providing a cover constructed from insulating material, wherein the cover comprises:

a top wall spaced from and disposed opposite the base plate;

a plurality of side walls, each side wall extending from the top wall towards the base plate, wherein at least one of the side walls is mechanically attached to the base plate, and wherein the base plate, the top wall, and the plurality of side walls define a cavity containing the plurality of terminals; and a plurality of third structures extending into the cavity from the top wall towards the base plate, wherein each third structure is disposed between the first and second structures of each barrier.

13. The method of claim 12 and further comprising:

configuring the first, second, and third structures such that the creepage dielectric strength between adjacent terminals is equal to or greater than the bulk dielectric strength of each structure.

14. The method of claim 12 and further comprising:

providing a first aperture in the cover through which the first structure extends; and providing a second aperture in the cover through which the second structure extends.

15. A terminal strip comprising:

a base plate constructed from an insulating material;

a plurality of terminals constructed from a conducting material and attached to the base plate, wherein the terminals are spaced along the base plate; and a barrier constructed from the insulating material and extending from the base plate, the barrier comprising:

a first structure extending from the base plate; and a second structure extending from the base plate and spaced from the first structure along the base plate, wherein the first and second structures are disposed between adjacent terminals and configured such that a creepage dielectric strength of the insulating material between adjacent terminals is equal to or greater than a bulk dielectric strength of the insulating material between adjacent terminals.

16. The terminal strip of claim 15 and further comprising:

a cover constructed from the insulating material, wherein the cover comprises:

a top wall spaced from and disposed opposite the base plate;

a plurality of side walls, each side wall extending from the top wall towards the base plate, wherein at least one of the side walls is mechanically attached to the base plate, and wherein the base plate, the top wall, and the plurality of side walls define a cavity containing the plurality of terminals; and a third structure extending into the cavity from the top wall towards the base plate and disposed between the first and second structures.

17. The terminal strip of claim 16, wherein the cover further comprises:

a plurality of apertures extending through and defined by the top wall, wherein each aperture is adapted to receive one of the first and second structures, and wherein the first and second structures extend through the top wall at one of the plurality of apertures.

18. The terminal strip of claim 15, wherein the base plate defines a passage extending therethrough, and wherein the passage is disposed between the first and second structures.

19. The terminal strip of claim 16, wherein the first and second structures are integral with the base plate, and wherein the third structure is integral with the cover.

20. The terminal strip of claim 16 and further comprising:

a plurality of conductor apertures, wherein each conductor aperture is defined by one of the side walls of the cover and the base plate, and wherein each conductor aperture is aligned with one of the terminals;

a plurality of electrical conductors; and a plurality of seals, each seal surrounding a portion of one of the electrical conductors, wherein each electrical conductor extends through one of the conductor apertures and attaches to one of the terminals, and wherein each seal is configured to be received within one of the conductor apertures.

* * * * *